US005234661A

United States Patent [19]

Ekbom

[11] Patent Number: 5,234,661

[45] Date of Patent: Aug. 10, 1993

[54] METHOD FOR MANUFACTURING RINGS OR DISCS HAVING A BLADE OR VANE RIM

[75] Inventor: Ragnar Ekbom, FinspÅng, Sweden

[73] Assignee: ABB Stal AB, Finspang, Sweden

[21] Appl. No.: 689,060

[22] Filed: Jun. 11, 1991

[30] Foreign Application Priority Data

Dec. 21, 1988 [SE] Sweden ..... 8804590

[51] Int. Cl.[5] ..... B22F 5/04

[52] U.S. Cl. ..... 419/49; 419/8

[58] Field of Search ..... 419/49, 8, 68, 26

[56] References Cited

U.S. PATENT DOCUMENTS 4,127,684 8/1978 Baker ..... 427/287
4,445,259 10/1984 Ekbom ..... 419/8
4,855,103 4/1989 Ekbom ..... 419/26
5,082,623 7/1992 Ekbom ..... 419/8

*Primary Examiner*—Donald P. Walsh
*Assistant Examiner*—Anthony R. Chi
*Attorney, Agent, or Firm*—Merchant & Gould, Smith, Edell, Welter & Schmidt

[57] ABSTRACT

Method for manufacturing rings or discs having a blade or vane rim from a powder which is received in a mold cavity formed by a gas-tight casing (10, 11, 12) and is isostatically hot pressed in the casing to form a monolithic body. A core (13) of hexagonal boron nitride or graphite having through apertures (14) corresponding to the profile of the individual blades or vanes, is located in the mold cavity said apertures being filled with powder to form the blades or vanes as an integrated portion of the monolithic body obtained by the isostatic hot pressing.

2 Claims, 1 Drawing Sheet

METHOD FOR MANUFACTURING RINGS OR DISCS HAVING A BLADE OR VANE RIM

The invention relates to a method for manufacturing rings or discs having a blade or vane rim from a powder which is received in a mold cavity formed by a gas-tight casing and is isostatically hot pressed in the casing to form a monolithic body.

Since it has not so far been deemed possible to form the blades as part of the body hot pressed isostatically if high quality and precision demands are to be met, it is at present customary in such manufacture to fabricate the blades by a separate process which does not necessarily include isostatic hot pressing, and to integrate in the manufacture of the rings or discs, the prefabricated blades with the rings or discs at the manufacture thereof by isostatic hot pressing. Thus, according to U.S. Pat. No. 4,445,259 the prefabricated blades are inserted through apertures which are adapted to the cross section of the blades, in a wall of the casing wherein the ring or disc is to be fabricated by hot pressing metal powder isostatically A substantial drawback of this prior art method is that there must be provided, between the blades and the wall of the casing, a gas-tight connection which causes problems as far as the manufacture of a high-quality product is concerned.

These problems are overcome by providing in the mold cavity a core of hexagonal boron nitride or graphite, into which the prefabricated blades are inserted, after the isostatic hot pressing said core being removed from the blades integrated with the body hot pressed isostatically, as described in U.S. Pat. No. 4,855,103. It has been found, however, that when this method is applied powder can penetrate into the core between the prefabricated blades and the walls of the aperture in the core in which the blades are inserted, so that there is obtained a thin skin of isostatically hot pressed material on the surface of the prefabricated blade which means that such blade no longer has a predetermined profile and predetermined dimensions. On the other hand there can be drawn from this phenomenon the conclusion that powder can be hot pressed isostatically also in very narrow form cavities, which has not been considered possible so far.

On the basis of the knowledge thus obtained the invention implies abandonment of the established principle to use in isostatic hot pressing of rings or discs having a blade rim, blades in the form of prefabricated elements, and it is proposed according to the invention a further development of the method according to U.S. Pat. No. 4,855,103 having the characterizing features of claim 1.

Figure 1:
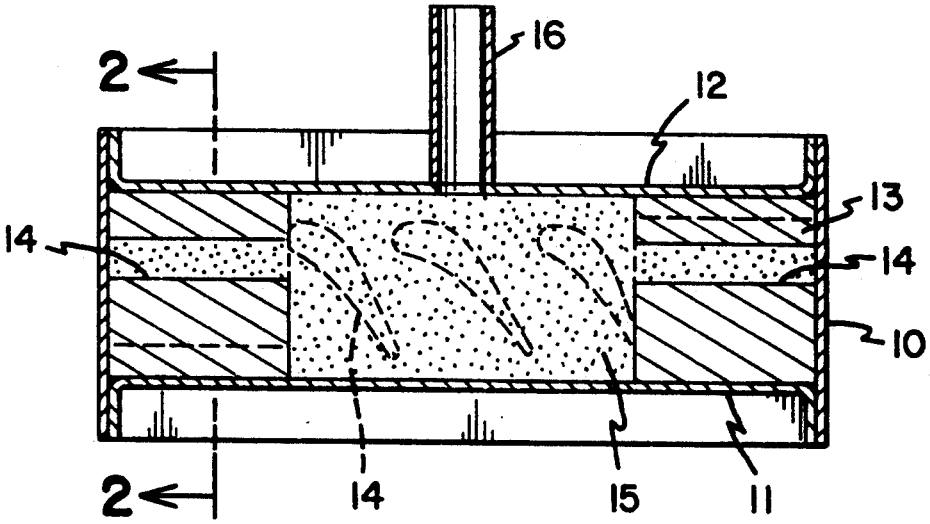
Figure 2:
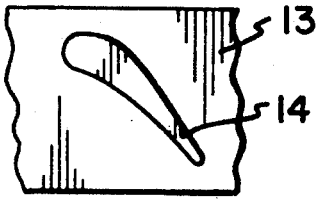

In order to further explain the invention an embodiment thereof will be described in more detail below reference being made to the accompanying drawing wherein FIG. 1 is an axial cross-sectional view of a casing for hot isostatic pressing of a disc having a blade rim by applying the method of the invention and FIG. 2 is a side view along line II—II in FIG. 1.

In the drawing there is shown a casing for isostatic hot pressing which is intended for manufacturing a disc having a blade rim, said casing comprising an outer cylindrical wall 10 of steel sheet, a circular annular bottom 11, and a circular annular cover 12, also these two being made of steel sheet. Said three elements are interconnected at gas-tight welds because the casing must be gas-tight for isostatic hot pressing. Before the cover is applied and connected to the outer wall there is located in the mold cavity formed by the casing a cylindrical annular body 13 which forms a core in the mold cavity and has a number of radially through apertures 14 of a shape which is exactly in agreement with the desired profile of the blades of the blade rim. In the embodiment of the method of the invention, which is preferred at present, the body 13 consists of hexagonal boron nitride which is a ceramic material which can be worked easily by means of cutting tools and can be removed easily by blasting, said material at the same time combining these properties with shape permanence at the high temperatures and pressures existing in isostatic hot pressing. The boron nitride is available commercially as a powder, and the body 13 is made from such powder by initially fabricating a solid cylindrical body by isostatic hot pressing. The isostatic hot pressing is performed in the conventional manner but since a ceramic material is involved the temperature at the isostatic hot pressing must be higher than in conventional isostatic hot pressing of a metal powder, viz. about 1700° C. At this high temperature the casing cannot be made of metal; it must be made of glass. The ring 13 is fabricated from the cylindrical body obtained, by machining. Preferably such machining is made by ultrasound working a tool being driven through the body 13 under the influence of ultrasound, the tool being scavenged with an emulsion of liquid (water or oil) and silicon carbide. In this manner apertures having a smooth surface, exact shape and high dimensional accuracy can be provided by a labour effort which is a small fraction only of the effort required if corresponding apertures were to be made by conventional milling. The body 13 accurately fits in the mold cavity so that it engages under tight seal the outer wall 10 at the cylindrical outside surface of the body when said body is located in the mold cavity. This cavity including the apertures 14 in the body is filled with the metal powder from which the isostatically hot pressed mold body is to be made, as shown at 15, and when this has been done the cover 12 is mounted to tightly close the casing with the body 13 engaging the bottom 11 and the cover at the flat annular end surfaces thereof. The cover is provided with a connection socket 16 for evacuating the mold cavity.

When the mold cavity has been evacuated isostatic hot pressing is performed in a completely conventional manner the powder forming a monolithic body which includes the disc as well as the blade rim.

When the casing has been removed which can be done in conventional manner by machining—the outer wall 10 possibly can remain on the outer ends of the blades as a bandage, which may be desired as far as long blades are concerned—and the body 13 thus has been uncovered also this body is removed which is done by blasting, in order to uncover the blades. Then, the monolithic body is ready for final finishing.

The method of the invention can also be applied to the manufacture of two rings having a blade rim between the rings. In that case the annular body 13 is located concentrically in the mold cavity with the outside cylindrical surface of the body radially spaced from the outer wall 10, the body being fixed in the mold cavity for example by being attached to the bottom 11 by spot welding. The mold cavity is filled with powder at both sides of the body 13 and also in the through apertures formed by said body.

The body 13 can be made of graphite instead of hexagonal boron nitride without causing any change in the procedure described. Graphite is considerably cheaper than hexagonal boron nitride but special steps must be taken in order to prevent carbonization of the powder material when the body 13 is made of graphite. The graphite body for instance can be coated with a layer of $Al_2O_3$, which has a thickness of 20 to 30 μm. When large blade rims are involved the price difference between boron nitride and graphite will be remarkable and then it may be preferred to make the body of graphite.

What is claimed is:

1. Method of manufacturing rings or discs having a blade or vane rim of a powder which is received in a mold cavity formed by a gas-tight casing (10, 11, 12) and is isostatically hot pressed in the casing to form a monolithic body, wherein there is located in the mold cavity a core (13) of hexagonal boron nitride or graphite, which is removed after isostatic hot pressing from the produced monolithic body by blasting, characterized in that the core (13) is provided with through apertures (14) corresponding to the profile of the individual blades or vanes, which are filled with powder (15) to form the blades or vanes as an integrated portion of the monolithic body obtained by isostatic hot pressing.

2. Method as in claim 1 wherein the apertures (14) in the body (13) are made by ultrasound working.

* * * * *

UNITED STATES PATENT AND TRADEMARK OFFICE

CERTIFICATE OF CORRECTION

PATENT NO. : 5,234,661

DATED : 10 August 1993

INVENTOR(S) : Ekbom

It is certified that error appears in the above-identified patent and that said Letters Patent is hereby corrected as shown below:

Item [75]:
In Inventor section on title page, delete "Finspång" and insert --Finspång--.
Item [73]:
In Assignee section on title page, delete "Finspang" and insert --Finspång--.

Signed and Sealed this

Twenty-sixth Day of April, 1994

*Attest:*

Bruce Lehman

BRUCE LEHMAN

*Attesting Officer*

*Commissioner of Patents and Trademarks*